US006698402B2

(12) United States Patent
Biesinger et al.

(10) Patent No.: US 6,698,402 B2
(45) Date of Patent: Mar. 2, 2004

(54) METHOD FOR OPERATING AN INTERNAL-COMBUSTION ENGINE

(75) Inventors: Herwig Biesinger, Korntal-Münchingen (DE); Hans-Jochen Blohm, Kernen (DE); Markus Schütz, Esslingen (DE); Hans-Karl Weining, Esslingen (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/933,413

(22) Filed: Aug. 20, 2001

(65) Prior Publication Data

US 2002/0046740 A1 Apr. 25, 2002

(30) Foreign Application Priority Data

Aug. 18, 2000 (DE) ..... 100 40 574

(51) Int. Cl.[7] ..... F02M 37/04
(52) U.S. Cl. ..... 123/520; 123/179.19
(58) Field of Search ..... 123/520, 519, 123/518, 516, 198 D, 521, 179.17–179.16

(56) References Cited

U.S. PATENT DOCUMENTS 4,862,856 A * 9/1989 Yokoe et al. ..... 123/519
5,056,493 A * 10/1991 Holzer ..... 123/518
5,207,734 A * 5/1993 Day et al.
5,349,935 A * 9/1994 Mezger et al. ..... 123/520
5,918,580 A * 7/1999 Hennrich et al. ..... 123/520
5,970,957 A * 10/1999 Fried et al. ..... 123/516
6,112,728 A * 9/2000 Schwegler et al. ..... 123/520
6,234,153 B1 * 5/2001 DeGroot et al. ..... 123/525
6,305,362 B1 * 10/2001 Kitamura et al. ..... 123/520
6,308,692 B1 * 10/2001 Ishikawa et al. ..... 123/519

FOREIGN PATENT DOCUMENTS

DE 195 22 075 12/1996

* cited by examiner

*Primary Examiner*—Carl S. Miller
(74) *Attorney, Agent, or Firm*—Kenyon & Kenyon

(57) ABSTRACT

In a method for operating an internal-combustion engine, a fuel/air mixture is fed to a combustion chamber of the internal-combustion engine and is ignited therein. At least for a defined period during the starting and/or warm-up of the internal-combustion engine, at least some of the liquid fuel is replaced with fuel which is in vapor form and is ignited in the at least one combustion chamber of the internal-combustion engine. The fuel which is in vapor form is taken from at least one fuel tank, which is connected to the internal-combustion engine, above a liquid-fuel level and/or from a charcoal canister which is connected to the fuel tank.

20 Claims, 1 Drawing Sheet

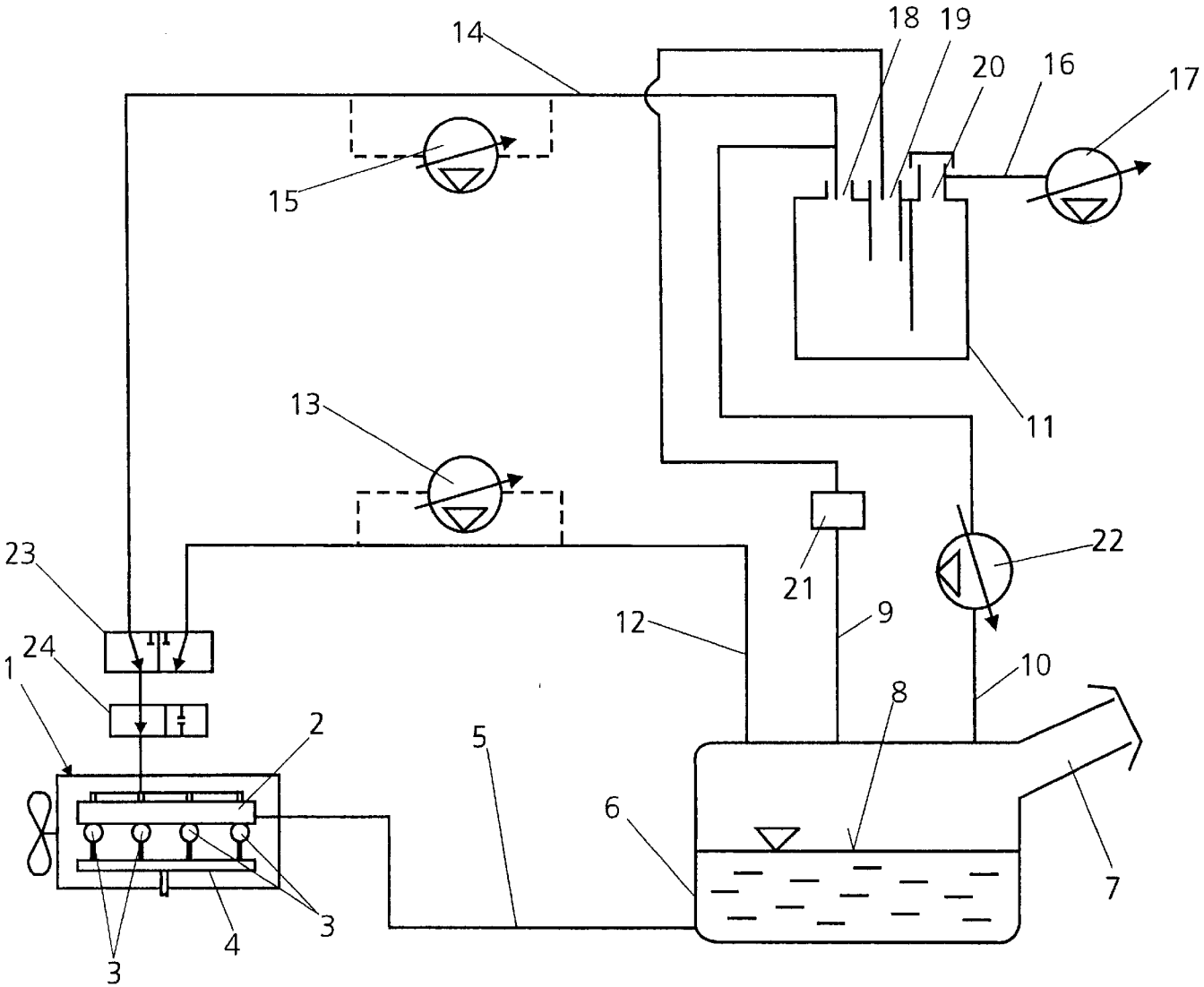
17
16
20
19
18
14
15
11
22
10
7
8
9
21
12
6
5
13
2
3
4
3
23
24
1

METHOD FOR OPERATING AN INTERNAL-COMBUSTION ENGINE

FIELD OF THE INVENTION

The present invention relates to a method for operating an internal-combustion engine and to an installation for performing the method.

BACKGROUND INFORMATION

German Published Patent Application No. 195 22 075 describes a method for forming a fuel/air mixture and a fuel feed installation for an internal-combustion engine, in which the fuel which is to be fed to the internal-combustion engine is vaporized and the fuel vapor which is generated is fed to the air which is sucked in by the internal-combustion engine. To reduce the emissions of hydrocarbons, the vaporization of the fuel is to be performed at relatively low temperatures.

However, a drawback of this method and the associated installation is the considerable additional outlay which is required for the vaporization of the fuel.

Since, in particular during and immediately after the cold-starting of an internal-combustion engine, there is as yet no or only an unsatisfactory conversion of the pollutants which are generated by the internal-combustion engine in a downstream catalytic converter, the exhaust emissions from the internal-combustion engine are very high in particular at this time. This fact is made even worse because, due to the poor preparation of the mixture in the cold state of the internal-combustion engine, the raw emissions themselves are particularly high, and because, in order to achieve more rapid heating of the catalytic converter, the mixture is additionally enriched, with the result that some unburnt fuel may leave the internal-combustion engine. However, it is precisely the emissions during a cold start which are the decisive factor in determining whether or not an internal-combustion engine is able to comply with a set exhaust restriction.

It is conventional to provide heated or air-surrounded injection valves or alternatively heating of the induction ports. However, practical implementation of these components either requires considerable outlay or means that their action is unsatisfactory with regard to reducing the exhaust emissions, in particular in the cold state of the internal-combustion engine.

Therefore, it is an object of the present invention to provide a method for operating an internal-combustion engine which, with the minimum possible outlay, enables emissions to be minimized during the starting operation and the warm-up phase of the internal-combustion engine.

SUMMARY

The above and other beneficial objects of the present invention are achieved by providing a method and an arrangement as described herein.

According to the present invention, fuel in vapor form may be taken either from the fuel tank or from the charcoal canister, an operation which is very easy to control in terms of the process involved and only entails an extremely low outlay on the installation. Fuel in vapor form, which is naturally contained in the fuel tank or in the charcoal canister, does not have to be laboriously generated, but rather may very easily be removed from these containers in order to start and/or warm up the internal-combustion engine.

With regard to the preparation of the mixture and the resulting crude emissions from the internal-combustion engine, fuel which is in vapor form is much more suitable than liquid fuel, and consequently replacing at least some of the liquid fuel with fuel which is in vapor form, in accordance with the present invention, enables the emissions from the internal-combustion engine to be reduced considerably while the engine is starting and/or warming up.

Fuel may also be removed from the fuel tank or from the charcoal canister simultaneously or sequentially.

An arrangement configured to perform the method according to the present invention may require very few additional components.

BRIEF DESCRIPTION OF THE DRAWING

The FIGURE schematically illustrates an arrangement configured to perform the method for operating an internal-combustion engine according to the present invention.

DETAILED DESCRIPTION

An internal-combustion engine 1, which is illustrated schematically in the FIGURE, includes an induction system 2, a plurality of combustion chambers 3 and an exhaust system 4. In a conventional manner, fuel mixed with air is fed to the combustion chambers 3 through the induction system 2 and, after combustion in the combustion chambers 3, the exhaust gases which are formed during the combustion are discharged through the exhaust system 4. In this case, the internal-combustion engine 1 operates according to the spark-ignition principle, and petrol is supplied as fuel.

A fuel tank 6, which is connected to the internal-combustion engine 1 via a fuel line 5, is configured to supply the induction system 2 or the combustion chambers 3 with fuel. The fuel tank 6 contains liquid fuel which is fed to the fuel tank 6 via a filling connection piece 7, and in the present case fills the fuel tank 6 up to the height of a liquid-fuel level 8.

Two lines 9 and 10 extend from the fuel tank 6 to a charcoal canister 11, via which the fuel tank 6 is vented, in a manner which is conventional and is therefore not described in more detail herein. In this case, the lines 9 and 10 extend from an area of the fuel tank 6 which is above the liquid-fuel level 8.

Furthermore, a line 12 extends from an area above the liquid-fuel level 8 of the fuel tank 6 to the induction system 2, in which line there is a suction pump 13. A further line 14, which extends from the charcoal canister 11 and in which there is a further suction pump 15, opens into the induction system 2. Finally, a further line 16, in which a pressure pump 17 is arranged, extends to the charcoal canister 11. The charcoal canister 11 is for this purpose provided with three openings, specifically an opening 18 into which the line 9 opens, an opening 19 from which the lines 10 and 14 extend and an opening 20 into which the line 16 opens. The arrangement of all three pumps 13, 15 and 17 is merely an example, since it would also be possible to provide only one or two of the pumps 13, 15 or 17, as will become clear below. If one or more of the pumps 13, 15 or 17 is eliminated, it is also possible to eliminate the associated line 12, 14 or 16. By way of example, if the pressure pump 17 were being used, the lines 9 and 14 may be eliminated. Furthermore, in this case the opening 20, which otherwise serves to vent the charcoal canister 11, may be closed off.

To allow the minimum possible quantity of emissions to pass from the combustion chambers 3 into the exhaust system 4 while the internal-combustion engine 1 is starting and/or warming up, at least some of the liquid fuel is replaced with fuel which is in vapor form at least for a certain period while the internal-combustion engine is starting and/or warming up. This fuel in vapor form may come from the fuel tank 6, specifically above the liquid-fuel level 8, since fuel in vapor form is naturally formed in this area and may be fed to the induction system 2 of the internal-combustion engine 1 via the line 12. For this purpose, the suction pump 13 may suck the fuel in vapor form out of the fuel tank 6. Alternatively, the suction pump 15 may also be used to suck fuel which is in vapor form in the charcoal canister 11 out of the latter via the line 14 and to feed it to the induction system 2 of the internal-combustion engine 1.

If a valve 21 which is located in the line 9 is open, the suction pump 13 may suck fuel which is in vapor form both out of the fuel tank 6 and, via the line 9, out of the charcoal canister 11 and feed it to the induction system 2 of the internal-combustion engine 1. Alternatively, with the valve 21 open, the suction pump 15 may also suck fuel which is in vapor form out of the charcoal canister 11 and/or out of the fuel tank 6.

With the aid of the pressure pump 17, the fuel which is in vapor form may also be forced out of the charcoal canister 11 via the line 14 or via the line 9 out of the fuel tank 6 into the induction system 2 of the internal-combustion engine 1. In addition or as an alternative to the measures described above, it is also possible to provide a pump 22 in the line 10, which sucks fuel which is in vapor form out of the charcoal canister 11 and, at the same time, forces it into the induction system 2 via the fuel tank 6. In this case too, the fuel which is in vapor form is carried out of the fuel tank 6 to the induction system 2.

The pumps 13, 15, 17 and 22 may be referred to as devices for producing a pressure difference between the fuel tank 6 and/or the charcoal canister 11 and the induction system 2 of the internal-combustion engine 1.

Alternatively, it is also possible for the fuel which is in vapor form simply to be sucked in with the aid of the induction-pipe vacuum of the internal-combustion engine 1, in which case the induction system 2 itself forms the device for producing a pressure difference between the fuel tank 6 and/or the charcoal canister 11 and the internal-combustion engine 1. It is therefore possible to feed the fuel which is in vapor form to the combustion chambers 3 by vacuum or by pressure.

Therefore, there are in principle three different options for removing fuel which is in vapor form and feeding it to the internal-combustion engine 1, specifically either only from the fuel tank 6 or only from the charcoal canister 11 or from the fuel tank 6 and the charcoal canister 11, one of these three options being selected according to the level of the fuel tank 6 and of the charcoal canister 11 and according to the operating state of the internal-combustion engine 1.

The lines 12 and 14 may be switched over by a reversing valve 23 arranged in these lines 12 and 14, so that, depending on the position of the reversing valve 23, the induction system 2 is connected either to the line 12 or to the line 14 and fuel may only be supplied from the corresponding line 12 or 14. In addition, a further metering valve 24, by which the amount of fuel in vapor form which is fed to the induction system 2 may be changed, is arranged between the reversing valve 23 and the induction system 2. If, while fuel which is in vapor form is being sucked out of the fuel tank 6 via the line 12, the reversing valve 23 closes the line 14 from the charcoal canister 11 to the induction system 2 of the internal-combustion engine 1, during this time the charcoal canister 11 may be regenerated via the space above the liquid-fuel level 8 in the fuel tank 6.

The quantity of fuel which is in vapor form in the fuel tank 6 above the liquid-fuel level 8, like the quantity of fuel which is in vapor form in the charcoal canister 11, is sufficient to start the internal-combustion engine 1 and to warm it up for a certain period without supplying liquid fuel. In this case, it is possible for the fuel which is in vapor form to be introduced into the induction system 2, in a manner which is not illustrated, via air ducts of so-called air-surrounded injection valves, via special gas injectors or at a central location.

The fuel which is in vapor form may in this case be fed to the combustion chambers 3 either as soon as the starting of the internal-combustion engine 1 commences, in which case an increasing proportion of the fuel which is in vapor form is replaced with liquid fuel as the internal-combustion engine 1 warms up, or liquid fuel may be fed to the combustion chambers 3 directly when the internal-combustion engine 1 is starting, but then shortly after the internal-combustion engine 1 has started, this liquid fuel is at least partially replaced with fuel which is in vapor form. In this case too, an increasing proportion of the fuel which is in vapor form would in turn be replaced with liquid fuel as the internal-combustion engine 1 warms up. The liquid fuel is in this case, as described above, fed to the induction system 2 via the fuel line 5.

Supplying liquid fuel in this manner may occur, for example, when a catalytic converter has reached its operating temperature or when the fuel which is in vapor form alone is no longer sufficient to operate the internal-combustion engine 1.

Moreover, to heat the catalytic converter, it is possible for fuel which is in vapor form to be fed, in a manner which is not illustrated, into the exhaust system 4 of the internal-combustion engine 1 and to be burnt in that system.

In this case, the combustion air ratio may be determined by a suitable sensor arrangement or a computational model in the engine management system of the internal-combustion engine 1 and may be matched to the desired state by changing the quantity of liquid fuel or fuel in vapor form which is fed to the internal-combustion engine 1.

If appropriate, sensors may be provided in the fuel tank 6, in one or more of the lines 9, 10, 12 or 14 or in the exhaust system 4, in order to determine the quantity of fuel which is fed in vapor form to the induction system 2.

What is claimed is:

1. A method for operating an internal-combustion engine, comprising the steps of:

supplying fuel in vapor form from one of:

at least one fuel tank, above a liquid-fuel level, connected to the internal-combustion engine and a charcoal canister connected to the at least one fuel tank, a first line extending from an area above the liquid fuel level in the at least one fuel tank to the internal combustion engine, the first line bypassing the charcoal cannister; and the at least one fuel tank, above the liquid-fuel level, connected to the internal-combustion engine, via the first line that bypasses the charcoal cannister;

replacing at least a portion of liquid fuel of a fuel/air mixture with the fuel in vapor form supplied in the supplying step at least for a defined period during at least one of starting and warm-up of the internal-combustion engine;

feeding the fuel-air mixture to at least one combustion chamber of the internal-combustion engine; and igniting the fuel/air mixture fed in the feeding step in the at least one combustion chamber.

2. The method according to claim 1, wherein the fuel/air mixture fed in the feeding step includes the fuel in vapor form while the internal-combustion engine is being started, the method further comprising the step of replacing an increasing proportion of fuel in vapor form in the fuel/air mixture with liquid fuel as the internal-combustion engine warms up.

3. The method according to claim 1, wherein the fuel/air mixture fed in the feeding step includes liquid fuel while the internal-combustion engine is being started;

wherein, immediately after the internal-combustion engine has been started, the liquid fuel in the fuel/air mixture is at least partially replaced in the replacing step with fuel in vapor form; and wherein the method further comprises the step of replacing the fuel in vapor form in the fuel/air mixture with an increasing proportion of liquid fuel as the internal-combustion engine warms up.

4. The method according to claim 1, wherein the fuel in vapor form is fed in the feeding step to the at least one combustion chamber by a vacuum.

5. A method for operating an internal-combustion engine, comprising the steps of:

supplying fuel in vapor form from at least one of at least one fuel tank, above a liquid-fuel level, connected to the internal-combustion engine and a charcoal canister connected to the at least one fuel tank, a first line extending from an area above the liquid fuel level in the at least one fuel tank to the internal combustion engine;

replacing at least a portion of liquid fuel of a fuel/air mixture with the fuel in vapor form supplied in the supplying step at least for a defined period during at least one of starting and warm-up of the internal-combustion engine;

feeding the fuel-air mixture to at least one combustion chamber of the internal-combustion engine; and igniting the fuel/air mixture fed in the feeding step in the at least one combustion chamber, wherein the fuel in vapor form is fed in the feeding step to the at least one combustion chamber by pressure.

6. A method for operating an internal-combustion engine, comprising the steps of:

supplying fuel in vapor form from at least one of at least one fuel tank, above a liquid-fuel level, connected to the internal-combustion engine and a charcoal canister connected to the at least one fuel tank, a first line extending from an area above the liquid fuel level in the at least one fuel tank to the internal combustion engine;

replacing at least a portion of liquid fuel of a fuel/air mixture with the fuel in vapor form supplied in the supplying step at least for a defined period during at least one of starting and warm-up of the internal-combustion engine;

feeding the fuel-air mixture to at least one combustion chamber of the internal-combustion engine;

igniting the fuel/air mixture fed in the feeding step in the at least one combustion chamber; and feeding fuel in vapor form to an exhaust system of the internal-combustion engine to heat a catalytic converter.

7. An arrangement, comprising:

an internal-combustion engine;

at least one fuel tank connected to the internal-combustion engine, a first line extending from an area above a liquid-fuel level in the at least one fuel tank to the internal combustion engine;

an induction system assigned to the internal combustion engine; and at least one device configured to produce a pressure difference between the induction system and at least one of the fuel tank and a charcoal canister;

wherein the arrangement is configured to perform a method of operating the internal combustion engine, the method including the steps of:

supplying fuel in vapor form from at least one of the fuel tank, above the liquid-fuel level, and the charcoal canister;

replacing at least a portion of liquid fuel of a fuel/air mixture with the fuel in vapor form supplied in the supplying step at least for a defined period during at least one of starting and warm-up of the internal-combustion engine;

feeding the fuel/air mixture to at least one combustion chamber of the internal-combustion engine; and igniting the fuel/air mixture fed in the feeding step in the at least one combustion chamber.

8. The arrangement according to claim 7, further comprising a suction pump arranged in the first line.

9. The arrangement according to claim 7, further comprising a second line extending from the charcoal canister to the internal-combustion engine and a suction pump arranged in the second line.

10. The arrangement according to claim 7, further comprising a third line extending to the charcoal canister and a pressure pump arranged in the third line.

11. An arrangement, comprising:

an internal-combustion engine;

at least one fuel tank connected to the internal-combustion engine;

an induction system assigned to the internal combustion engine;

at least one device configured to produce a pressure difference between the induction system and at least one of the fuel tank and a charcoal canister; and at least one of:

a first line extending from an area above the liquid-fuel level in the fuel tank to the internal-combustion engine and a first suction pump arranged in the first line;

a second line extending from the charcoal canister to the internal-combustion engine and a second suction pump arranged in the second line; and a third line extending to the charcoal canister and a pressure pump arranged in the third line;

wherein the arrangement is configured to perform a method of operating the internal combustion engine, the method including the steps of:

supplying fuel in vapor form from at least one of the fuel tank, above a liquid-fuel level, and the charcoal canister;

replacing at least a portion of liquid fuel of a fuel/air mixture with the fuel in vapor form supplied in the supplying step at least for a defined period during at least one of starting and warm-up of the internal-combustion engine;

feeding the fuel/air mixture to at least one combustion chamber of the internal-combustion engine; and igniting the fuel/air mixture fed in the feeding step in the at least one combustion chamber.

12. The arrangement according to claim 11, further comprising a reversing valve arranged in the first line and the second line.

13. The arrangement according to claim 12, further comprising a metering valve arranged between the reversing valve and the induction system.

14. A method for operating an internal-combustion engine, comprising the steps of:

supplying fuel in vapor form from at least one of at least one fuel tank, above a liquid-fuel level, connected to the internal-combustion engine and a charcoal canister connected to the at least one fuel tank, a first line extending from an area above the liquid fuel level in the at least one fuel tank to the internal combustion engine;

replacing at least a portion of liquid fuel of a fuel/air mixture with the fuel in vapor form supplied in the supplying step at least for a defined period during at least one of starting and warm-up of the internal-combustion engine;

feeding the fuel-air mixture to at least one combustion chamber of the internal-combustion engine; and igniting the fuel/air mixture fed in the feeding step in the at least one combustion chamber, wherein the fuel in vapor form is supplied simultaneously from the first line and from a second line extending from the charcoal canister to the internal combustion engine.

15. A method for operating an internal-combustion engine, comprising the steps of:

supplying fuel in vapor form from at least one of at least one fuel tank, above a liquid-fuel level, connected to the internal-combustion engine and a charcoal canister connected to the at least one fuel tank, a first line extending from an area above the liquid fuel level in the at least one fuel tank to the internal combustion engine;

replacing at least a portion of liquid fuel of a fuel/air mixture with the fuel in vapor form supplied in the supplying step at least for a defined period during at least one of starting and warm-up of the internal-combustion engine;

feeding the fuel-air mixture to at least one combustion chamber of the internal-combustion engine; and igniting the fuel/air mixture fed in the feeding step in the at least one combustion chamber, wherein the fuel in vapor form is supplied sequentially from the first line and then a second line extending from the charcoal canister to the internal combustion engine.

16. A method for operating an internal-combustion engine, comprising the steps of:

supplying fuel in vapor form from at least one of at least one fuel tank, above a liquid-fuel level, connected to the internal-combustion engine and a charcoal canister connected to the at least one fuel tank, a first line extending from an area above the liquid fuel level in the at least one fuel tank to the internal combustion engine;

replacing at least a portion of liquid fuel of a fuel/air mixture with the fuel in vapor form supplied in the supplying step at least for a defined period during at least one of starting and warm-up of the internal-combustion engine;

feeding the fuel-air mixture to at least one combustion chamber of the internal-combustion engine; and igniting the fuel/air mixture fed in the feeding step in the at least one combustion chamber, wherein the fuel in vapor form is supplied sequentially from a second line extending from the charcoal canister to the internal combustion engine and then the first line.

17. The method according to claim 4, wherein the vacuum includes an induction-pipe vacuum of the internal combustion engine.

18. An arrangement, comprising:

an internal-combustion engine;

at least one fuel tank connected to the internal-combustion engine, a first line extending from an area above a liquid-fuel level in the at least one fuel tank to the internal combustion engine;

an induction system assigned to the internal combustion engine; and at least one device configured to produce a pressure difference between the induction system and at least one of the fuel tank and a charcoal canister;

wherein the arrangement is configured to perform a method of operating the internal combustion engine, the method including the steps of:

supplying fuel in vapor form from at least one of the fuel tank, above the liquid-fuel level, and the charcoal canister;

replacing at least a portion of liquid fuel of a fuel/air mixture with the fuel in vapor form supplied in the supplying step at least for a defined period during at least one of starting and warm-up of the internal-combustion engine;

feeding the fuel/air mixture to at least one combustion chamber of the internal-combustion engine;

igniting the fuel/air mixture fed in the feeding step in the at least one combustion chamber;

a fourth line extending from the area above the liquid-fuel level of the fuel tank and the charcoal cannister; and a suction pump arranged in the fourth line to suck fuel in vapor form out of the canister and into the induction system via the at least one fuel tank.

19. An arrangement, comprising:

an internal-combustion engine;

at least one fuel tank connected to the internal-combustion engine, a first line extending from an area above a liquid-fuel level in the at least one fuel tank to the internal combustion engine;

an induction system assigned to the internal combustion engine; and at least one device configured to produce a pressure difference between the induction system and at least one of the fuel tank and a charcoal canister;

wherein the arrangement is configured to perform a method of operating the internal combustion engine, the method including the steps of:

supplying fuel in vapor form from at least one of the fuel tank, above the liquid-fuel level, and the charcoal canister;

replacing at least a portion of liquid fuel of a fuel/air mixture with the fuel in vapor form supplied in the supplying step at least for a defined period during at least one of starting and warm-up of the internal-combustion engine;

feeding the fuel/air mixture to at least one combustion chamber of the internal-combustion engine;

igniting the fuel/air mixture fed in the feeding step in the at least one combustion chamber;

a fifth line extending from the area above the liquid-fuel level of the fuel tank and the charcoal cannister; and a valve arranged in the fifth line to control a flow of the fuel in vapor form.

20. The arrangement according to claim 7, wherein the internal combustion engine includes an induction-pipe vacuum.

* * * * *